United States Patent [19]

Mossberg

[11] Patent Number: 5,020,259

[45] Date of Patent: Jun. 4, 1991

[54] FIREARM LOCK

[76] Inventor: Alan I. Mossberg, Ste. 337, 4375-34th St. S., St. Petersburg, Fla. 33711

[21] Appl. No.: 528,251

[22] Filed: May 24, 1990

[51] Int. Cl.[5] ..... F41A 17/02
[52] U.S. Cl. ..... 42/70.110
[58] Field of Search ..... 42/70.11

[56] References Cited

U.S. PATENT DOCUMENTS

| | | | |
|---|---|---|---|
| 3,018,576 | 1/1962 | Riechers | 42/70.11 |
| 3,605,311 | 9/1971 | Hermann | 42/70.11 |
| 3,634,963 | 1/1972 | Hermann | 42/70.11 |
| 4,122,620 | 10/1978 | Alexander | 42/70.11 |
| 4,654,992 | 4/1987 | Lavergne | 42/70.11 |

OTHER PUBLICATIONS

"Sportsman's Digest," *The Sunday Star*, Oct. 26, 1969.
"What's New," *Guns & Ammo*, May 1983, p. 28.

*Primary Examiner*—Charles T. Jordan
*Assistant Examiner*—Richard W. Wendtland
*Attorney, Agent, or Firm*—McCormick, Paulding & Huber

[57] ABSTRACT

A firearm lock resembling a high security padlock of conventional type secured to an associated firearm to disable the firearm. The key for releasing the locking mechanism to enable the lock to be removed from the firearm comprises a live round of ammunition for the firearm which may be discharged in the firearm after the lock has been removed.

19 Claims, 1 Drawing Sheet

FIREARM LOCK

BACKGROUND OF THE INVENTION

This invention relates in general to safety devices for firearms and deals more particularly with an improved lock for securing a firearm in a disabled or inoperative condition.

A firearm used as a home defense weapon must be stored at a convenient location to be readily accessible in the event of emergency. However, if the firearm is kept where it is accessible to children in the household the firearm should be stored in locked condition so that it cannot be operated without first removing the locking device which secures it.

Heretofore, various conventional key operated locking devices have been available for this purpose. However, such devices are cumbersome to operate in darkness or in stressful situations. Further, the risk of key loss or misplacement may render a locked weapon useless in time of emergency. Combination locks are generally unsatisfactory for this purpose, because of the time required to open such locks. Combination locks are also difficult to open in darkness.

Specifically, it is the aim of the present invention to provide an improved firearm lock for securing a firearm in an inoperative condition and which may be readily opened without a conventional key, numerical combination or the like.

SUMMARY OF THE INVENTION

In accordance with the present invention an improved firearm lock for temporarily rendering a firearm inoperative comprises disabling means for connection to the firearm to prevent the firearm from discharging a round of ammunition, locking means for securing the disabling means in connected relation to the firearm to maintain the firearm in disabled condition, and means for releasing the locking means to enable removal of the disabling means from the firearm and including a round of ammunition for the firearm. After the lock has been removed from the firearm the round of ammunition which has been used to unlock it may be inserted into and discharged by the firearm.

DETAILED DESCRIPTION OF PREFERRED EMBODIMENT

Figures 1, 2, 3, 4, 5, 6:
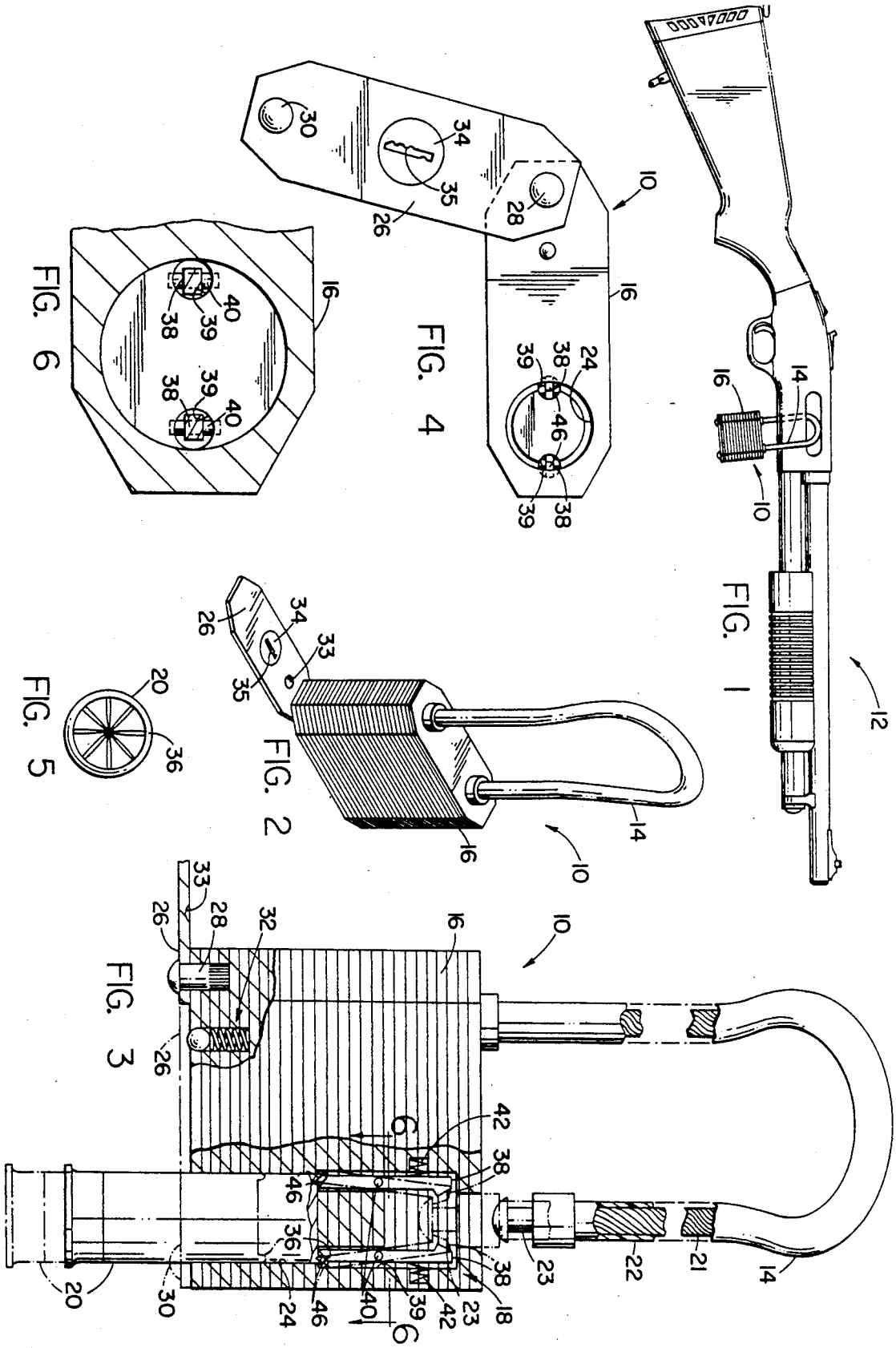
FIG. 1 is a side elevational view showing a firearm lock embodying the present invention connected to an associated firearm.
FIG. 2 is a somewhat enlarged perspective view of the firearm lock shown in FIG. 1.
FIG. 3 is a somewhat further enlarged fragmentary side elevational view of the firearm lock shown partially in vertical section and in unlocked condition.
FIG. 4 is a bottom view of the firearm lock.
FIG. 5 is an end view of the round of ammunition shown in FIG. 3.
FIG. 6 is a further enlarged fragmentary sectional view taken along the line 6—6 of FIG. 3.

Turning now to the drawing, and referring first particularly to FIG. 1, a firearm locking device embodying the present invention and indicated generally at 10 is shown connected in locked or secured condition to an associated firearm or shotgun designated generally by the reference numeral 12. While the firearm lock of the present invention may be produced in various forms, the illustrated lock 10 closely resembled a heavy duty padlock and has a securing element or flexible cable shackle 14 and a lock body 16. In FIG. 1, the breech bolt of the shotgun 12 is shown locked in open or retired position. The shackle 14 for securing the lock assembly 10 to the firearm is threaded through the loading and ejecting ports of the firearm 12 between the forward end of the breech bolt and the firing chamber and disables the firearm by preventing movement of the breech bolt to battery position.

The flexible shackle 14 is locked in engagement with the lock body 16 by a locking mechanism indicated generally at 18 in FIG. 3 and contained within the lock body. Thus, the lock body cooperates with the flexible shackle 14 to secure the lock assembly 10 in connected relation to the firearm 12 and maintain the firearm in disabled condition thereby rendering it incapable of discharging a round of ammunition.

In accordance with the present invention, the "key" for releasing the locking mechanism 18 to enable removal of the lock assembly 10 from the firearm 12 comprises a round of ammunition or shotgun shell 20 for the shotgun 12, as shown in FIG. 3. After the lock assembly 10 has been removed from the shotgun 12, the shotgun shell 20, used to open the lock assembly, may be loaded into the chamber of the shotgun 12 and discharged by the gun in a conventional manner, all of which will be evident from the further description which follows:

Considering now the firearm lock 10 in further detail and referring particularly to FIGS. 2–4, the shackle 14 preferably comprises a flexible hardened stranded steel cable 21 of a type conventionally used on portable locking devices. Preferably, and as shown, the cable 21 is covered by a durable outer layer of flexible plastic material 22 which protects the firearm from being scratched or otherwise damaged by the cable. One end of the illustrated cable is preferably anchored in fixed position within the lock body 16. In the illustrated embodiment of the invention a connecting member 23 firmly attached to the opposite end of the cable is adapted for cooperation in locking engagement with the locking mechanism 18 contained within the lock body 16, as will be hereinafter further discussed.

The lock body may take various forms, however, the illustrated lock body 16 is manufactured to resemble the body of a heavy duty laminated padlock. The body 16 may be formed by a plurality of connected laminations or from a solid block of material which may be scored or otherwise marked to resemble laminations. A generally cylindrical bore 24 formed in the body opens through the lower surface of the body 16, as it appears in FIG. 3, and is sized to receive the forward end portion of a shotgun shell, such as the shell 20.

A cover plate 26 is secured to the lower surface of the body 16 by a pivot pin 28 for pivotal movement between an open position shown in full lines and a closed position indicated by broken lines in FIGS. 2 and 3. In its closed position the cover plate 26 conceals the bore 24 and resembles the lowermost lamination on a laminated lock body. The pivot pin 28 may be headed to resemble a rivet such as usually used for maintaining the body of a laminated padlock in assembly. A matching false rivet head 30 is preferably formed on the opposite end of the cover plate 26 to stimulate a second rivet for holding the laminations in place.

A conventional spring-ball detent mechanism, indicated generally at 32 and carried by the lock body 16, cooperates with an associated recess 33 in the cover plate 26 to releasably retain the cover plate in closed position. A false operating means or dummy key plug 34 mounted or formed on the cover plate and having a keyway 35 formed therein further serves to create the impression that the lock assembly 10 is a conventional heavy duty key operated padlock. Thus, the cover plate 26, dummy key plug 34 and keyway 35 disguise the actual operational characteristics of the locked 10.

The nature of the locking mechanism employed to connect the free end of the shackle to the lock body is not critical and various types of mechanism may be employed to secure one or both ends of the securing element or cable 14. However, it is generally desirable that the lock mechanism cooperate with at least one surface on the round of ammunition which is unique to the particular round of ammunition used in the firearm to be locked. Thus, for example, the illustrated shotgun shell 20 has a forwardly projecting annular rim 36 which defines a shallow generally cylindrical recess at its forward end. This annular rim is employed to effect release of the illustrated locking mechanism 18 as will be hereinafter described.

The illustrated locking mechanism 18 essentially comprises a plurality of axially extending levers 38,38 pivotally supported in circumaxially spaced relation to each other about the axis of the bore 24 and within associated cylindrical cavities in the lock body. Each lever is supported intermediate its ends in an associated lever retaining slot 39, which opens into the bore 24, by a pivot pin 40 to pivot about an associated axis extending in a generally transverse direction relative to the axis of the bore 24. At its upper end each lever has a hook-like projection for engagement within an annular recess in the connecting member 23. At its opposite or lower end each lever has an upwardly and outwardly inclined cam surface 46 for engagement with the inner surface of the annular rim 36 when the shell 20 is inserted into the bore 24. A spring 42 associated with each lever 38 biases the lever toward a latching position with respect to the connecting member 23, as shown in FIG. 3. When a shotgun shell 20 is inserted into the bore the rim 36 simultaneously engages cam surfaces 46,46 on the various levers 38,38 and pivots the levers in unison from locked position shown in broken lines in FIG. 3 to an unlocked position shown in full lines and out of engagement with the connecting member 23 whereby the connecting member may be separated from the lock body 16 to enable release or removal of the flexible shackle 14 from the firearm 12.

The lock assembly 10 is not necessarily intended to provide a high degree of security, since its formidable appearance creates the impression to one not familiar with the device that the firearm is well secured. The mere appearance of high security afforded by the device should be sufficient to deter a child from attempting unauthorized removal of the lock from the firearm. However, since the locking mechanism 18 is adapted to respond to a particular characteristic unique to a round of ammunition for the firearm, the lock may be constructed to be difficult, if not impossible, to open using readily available implements which may be inserted into the bore 24. Thus, a degree of security may be attained sufficient for the purpose for which the lock assembly is intended.

In the event of emergency, one familiar with the locking mechanism can easily operate it in darkness using only a round of ammunition for the firearm which would normally be kept readily available for loading the firearm in the event of such emergency. After a round of ammunition, such as the shell 20, has been used to unlock the firearm lock 10 and the lock assembly has been removed from the firearm, the round of ammunition may be chambered in the usual manner and discharged by the firearm, if necessary.

While the firearm lock of the present invention has been illustrated and described with reference to a shotgun, it should be understood that the concept embodied in this invention may be readily utilized in locking devices for other types of firearms. Generally, the characteristics of the particular firearm to be secured will dictate the requirements for the lock assembly. Thus, for example, if the firearm does not have multiple ports through which a flexible shackle may be threaded, a different type of locking device may be necessary to secure the firearm. However, it should now be evident that the concepts illustrated by the presently preferred embodiment of the invention may be equally applicable to firearm locks of other types.

I claim:

1. A lock for a firearm having a chamber sized to received an associated round of ammunition to be discharged by said firearm, said lock comprising a lock body having an opening therein communicating with the interior thereof, locking means for attaching said lock body to a firearm such as aforesaid and including a locking mechanism within said lock body having a locked position corresponding to a secured condition of said locking means and an unlocked position corresponding to a released condition of said locking means, and means for releasing said locking mechanism from its locked position in response to insertion of a portion of an associated round of ammunition such as aforesaid through said opening and to a predetermined position within said lock body.

2. A locking device for a firearm as set forth in claim 1 wherein said locking means comprises a shackle for locking engagement with said locking mechanism within said lock body when said locking mechanism is in its locked position.

3. A locking device for a firearm as set forth in claim 2 wherein said shackle comprises a flexible cable.

4. A locking device for a firearm as set forth in claim 1 wherein said lock body has a bore defining said opening and sized to slidably receive a portion the associated round of ammunition therein and the round of ammunition engages said locking mechanism within said bore to release said locking mechanism from its locked positin.

5. A locking device for a firearm as set forth in claim 4 including means for concealing said bore.

6. A locking device for a firearm as set forth in claim 4 wherein said locking mechanism includes at least one element extending into said bore when said locking mechanism is in its locked position for engagement by the round of ammunition to release said locking mechanism from its locked position.

7. A lock for a firearm as set forth in claim 1 wherein said lock has means for disguising the actual operating characterisitcs of said lock.

8. A lock for a firearm as set forth in claim 7 wherein said disguising means comprises a cover plate forming a part of said lock body and supported for movement between a first position wherein said opening is exposed and a second postiion wherein said opening is concelaed by said cover plate.

9. A lock for a firearm as set forth in claim 8 wherein said disguising means includes a dummy operating means on said lock body.

10. A lock for a firearm as set forth in claim 9 wherein said dummy operating means comprises a dummy keyway formed in said lock body.

11. A lock for a firearm as set forth in claim 10 wherein said dummy operating means comprises a dummy key plug on said lock body and said keyway is formed in said dummy key plug.

12. A lock for a firearm as set forth in claim 1 wherein said lock includes means for biasing said locking mechanism to and maintaining it in said locked position and said releasing means comprises means for moving said locking mechanism from said locked position to said unlocked position.

13. A locking device for disabling a firearm adapted to discharge a round of ammunition, said locking device comprising, disabling means for connection to the firearm to prevent the firearm from discharging a round of ammunition, locking means having a locking condition for releasably securing said disabling means in connected relation to the firearm to maintain the firearm in disabled condition, and including a lock body having an opening therein, and means for releasing said locking means from said locking condition to enable removal of said disabling means from the firearm in response to insertion of a round of ammunition for the firearm into said opening and to a predetermined position within said lock body.

14. The combination comprising a firearm, a round of ammunition for said firearm, and a locking device for said firearm and comprising disabling means for connection to said firearm to prevent said firearm from discharging a round of ammunition, locking means for securing said disabling means in connected relation to said firearm to maintain the firearm in disabled condition including a lock body having an opening therein, and means for releasing said locking means to enable removal of said disabling means from the firearm in response to insertion of said round of ammunition into said opening and to a predetermined position within said lock body.

15. A locking device for a firearm having a chamber sized to receive therein an associated round of ammunition and comprising a lock body having a bore opening outwardly therethrough and sized to receive a portion of said round of ammunition therein, a locking mechanism disposed within said lock body and having an exposed portion within said bore, said locking mechanism being movable between locking and unlocking positions, means normally biasing said locking mechanism to its locking position, and securing means including a locking element for connection to the firearm and engageable with said locking mechanism within said lock body, said locking mechanism in its locking position cooperating in engagement with said locking element to retain said locking element in connected relation to said firearm, said round of ammunition being insertable into said bore to engage said exposed portion and move said locking mechanism from said locking position to said unlocking position, whereby said locking element may be removed from the firearm.

16. A locking device as set forth in claim 15 wherein said locking element comprises a shackle.

17. A locking device as set forth in claim 16 wherein said shackle comprises a flexible cable.

18. A locking device as set forth in claim 17 including means for concealing said bore.

19. A locking device as set forth in claim 18 including dummy lock operating means for disguising the actual means for operating said locking device.

* * * * *